US005875671A

United States Patent [19]

Hauck et al.

[11] Patent Number: 5,875,671

[45] Date of Patent: Mar. 2, 1999

[54] CASSETTE-TYPE ROLL STAND FOR A TWO-HIGH ROLL PAIR

[75] Inventors: Albert Hauck; Karl Keller, both of Hilchenbach, Germany

[73] Assignee: SMS Schloemann-Siegmag Aktiengesellschaft, Dusseldorf, Germany

[21] Appl. No.: 56,327

[22] Filed: Apr. 7, 1998

[30] Foreign Application Priority Data

Apr. 19, 1997 [DE] Germany ..... 197 16 574.5

[51] Int. Cl.[6] ..... B21B 31/07; B21B 31/08

[52] U.S. Cl. ..... 72/237; 72/238

[58] Field of Search ..... 72/237, 238, 239, 72/240, 245, 246, 247, 248

[56] References Cited

U.S. PATENT DOCUMENTS 5,590,557 1/1997 Keller et al. ..... 72/238

5,613,392 3/1997 Muller et al. ..... 72/238

*Primary Examiner*—Joseph J. Hail, III
*Assistant Examiner*—Rodney Butlar
*Attorney, Agent, or Firm*—Freidrich Kueffner

[57] ABSTRACT

A cassette-type roll stand for a two-high roll pair, wherein the bearing chocks of the roll stand are guided in a cassette formed by two housing frames which can be moved into and out of the roll stand. The housing frames are constructed as upwardly open U-shaped frames having oppositely located side members, wherein the side members are provided with guides for the bearing chocks of the lower roll and wherein one of the side members has extension projections with pivot bearings for the sides of the bearings chocks of the upper roll facing the pivot bearings. The other sides of the bearing chocks facing away from the extension projections are connected through spring-elastic connecting rods to the corresponding sides of the bearing chocks of the lower roll. In addition, an adjusting device and support and measuring devices for the cassette-type roll stand are arranged in the support frame.

6 Claims, 2 Drawing Sheets

CASSETTE-TYPE ROLL STAND FOR A TWO-HIGH ROLL PAIR

BACKGROUND OF THE INVENTION

1. Field of the Invention

The present invention relates a cassette-type roll stand for a two-high roll pair, wherein the bearing chocks of the roll stand are guided in a cassette formed by two housing frames which can be moved into and out of the roll stand.

2. Description of the Related Art

Cassette-type roll stands of the above-described type are always constructed as complete roll stands with their own adjusting devices and partially with their own roll fittings as well as other support devices and measuring devices. The roll stands are usually moved on rails into the support structure and are then secured and aligned in the support structure. This complete configuration, which must also be present in the cassette-type roll stands which are used for the support structure and are intended for replacement, is technically difficult and expensive; the configuration is also technically difficult with respect to the preassembly of the cassette-type roll stands to be replaced.

SUMMARY OF THE INVENTION

Therefore, it is the primary object of the present invention to provide a cassette-type roll stand which is technically of simpler construction and which can also be exchanged more easily.

In accordance with the present invention, the housing frames are constructed as upwardly open U-shaped frames having oppositely located side members, wherein the side members are provided with guides for the bearing chocks of the lower roll and wherein one of the side members has extension projections with pivot bearings for the sides of the bearings chocks of the upper roll facing the pivot bearings. The other sides of the bearing chocks facing away from the extension projections are connected through spring-elastic connecting rods to the corresponding sides of the bearing chocks of the lower roll. In addition, an adjusting device and support and measuring devices for the cassette-type roll stand are arranged in the support frame.

The configuration of the cassette-type roll stand and of the support frame according to the present invention results in a very simple construction of the cassette-type roll stand itself as well as of the support frame. The technical requirements are further reduced because of the fact that the adjusting and measuring devices only have to be provided once, namely, in the support frame. This also leads to a simplification of the maintenance and adjusting operations at the stands prepared for an exchange and, to a corresponding reduction of the time required for the exchange.

In accordance with another feature of the present invention, the two bearing chocks of the upper roll can be connected by a pivotable crosshead and the two bearing chocks connected by the crosshead can be supported in the extension projections of the side members. The support frame may be composed of an upper and a lower crosshead which are connected to each other by means of tension rods, wherein a preferably hydraulic adjusting device is arranged below the upper crosshead, and the support elements for the cassette-type roll stand and a pressure pickup or sensor are arranged on the lower crosshead.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DESCRIPTION OF THE PREFERRED EMBODIMENTS

Figure 1:
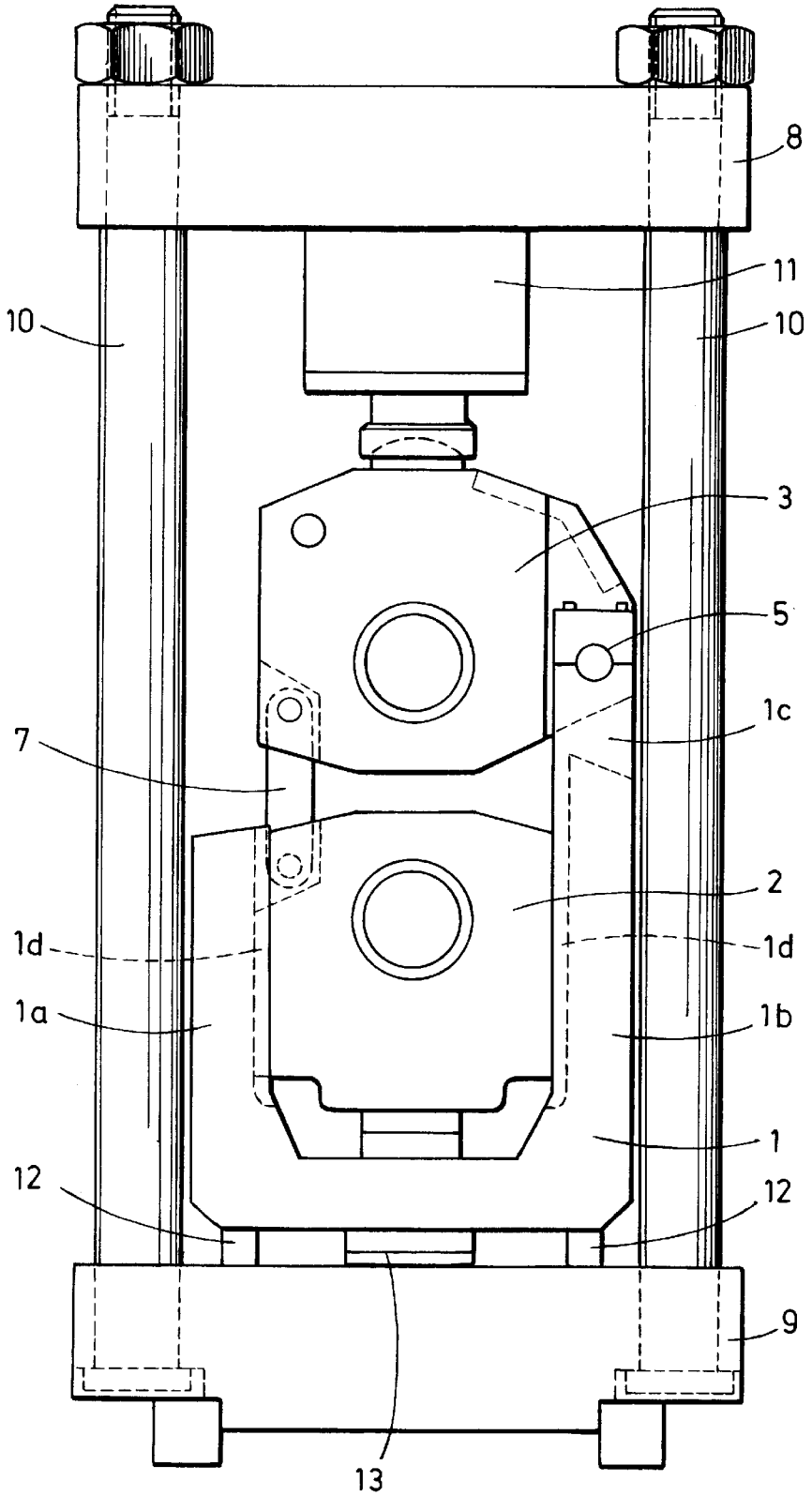
FIG. 1 is a schematic side view of a cassette-type roll stand placed in a support frame.
Figure 2:
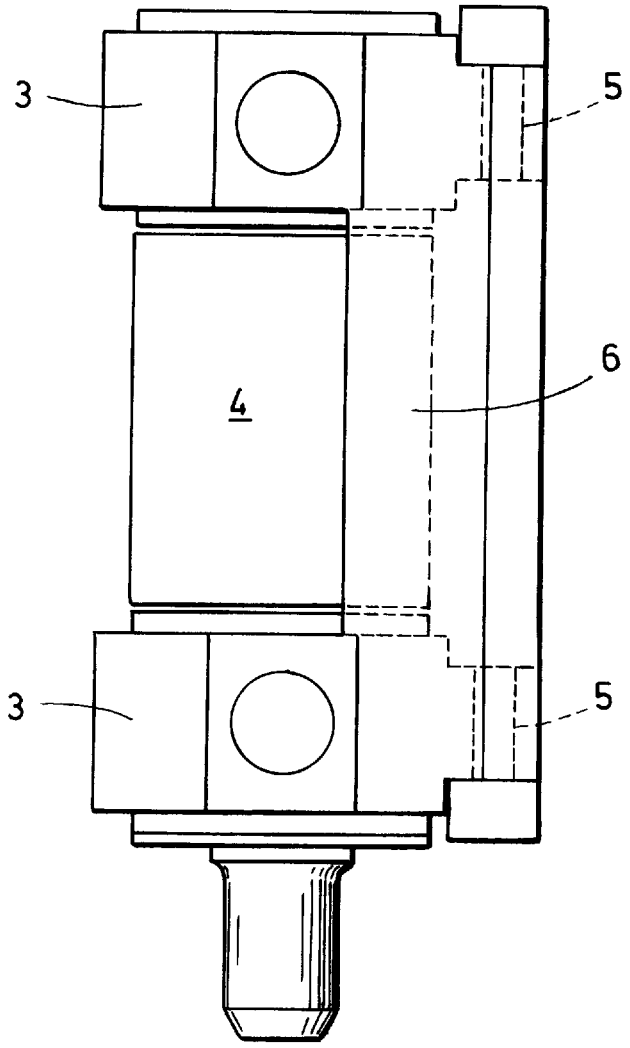
FIG. 2 is a schematic partial top view of the roll stand of FIG. 1.

As illustrated in FIG. 1 of the drawing, the cassette-type roll stand includes a pair of housing frames formed by upwardly open U-shaped frames 1. Of the oppositely located pairs of flanges or side members 1*a*, 1*b* of each frame, one side member 1*b* has extension projections 1*c* and both side members 1*a* and 1*b* have guides 1*d* at an inner side of the side members for the bearing chocks 2 of the lower roll, not shown, of the two-high roll pair. The sides of the bearing chocks 3 facing the extension projections 1*c* are hinged through pivot bearings 5 to the bearing chocks 3 and are connected to each other through a crosshead 6. The sides of the bearing chocks 3 facing away from the extension projections 1*c* are hinged through a connecting rod 7 to the corresponding sides of the bearing chocks 2 for the lower roll. This connecting rod 7 is of a spring-elastic material.

As also shown in FIG. 1, the cassette-type roll stand is placed in a support frame which is composed of an upper crosshead 8 and a lower crosshead 9, wherein the crossheads 8 and 9 are connected to each other through tension rods 10. The upper crosshead 8 supports the adjusting device 11 which acts on the chocks 3 for the upper roll 4, and the rails 12 for moving the cassette-type roll stand in and out and a pressure pickup 13 are arranged on the lower crosshead 9.

The bearing chocks 2 of the lower roll guided in the guides 1*d* of the U-shaped frame 1 are adjusted with respect to their vertical location by means of shims, not shown, and the bearing chocks 3 of the upper roll 4, which are pivotably supported in the extension projections 1*c* of the side members 1*b* as indicated in dash-dot lines, are supported through the connecting rods 7 on the bearing chocks 2 for the lower roll. The U-shaped frame 1 also supports the roll fittings, not shown. The cassette-type roll stand equipped in this manner can be assembled with the rolls and the roll fittings outside of the rolling mill and can be inserted in this assembled state.

In the rolling train, the cassette-type roll stand is pushed into the support frame on the rails 12 and is secured against displacement in the support frame. Subsequently, the adjusting device can be activated and both rolls are initially adjusted to contact each other for zeroizing the adjustment and are subsequently moved to adjust the desired roll gap.

While specific embodiments of the invention have been shown and described in detail to illustrate the inventive principles, it will be understood that the invention may be embodied otherwise without departing from such principles.

We claim:

1. A cassette-type roll stand for a two-high roll pair with an upper roll and a lower roll, the roll stand comprising bearing chocks of the upper roll and bearing chocks of the lower roll, comprising a cassette comprised of two housing frames and moveable into and out of a support frame, wherein the housing frames are comprised of upwardly open U-shaped frames having oppositely located side members, guides being defined in the side members for the bearing chocks of the lower roll, wherein one of the side members has extension projections with pivot bearings for sides of the bearings chocks of the upper roll facing the extension projections, further comprising spring-elastic connecting rods for connecting sides of the bearing chocks of the upper roll facing away from the extension projections to corresponding sides of the bearing chocks of the lower roll, wherein an adjusting device, supports and measuring devices for the stand are mounted in the support frame.

2. The cassette-type roll stand according to claim 1, wherein the bearing chocks of the upper roll are connected to each other through a pivoting crosshead and the connected bearing chocks of the upper roll are mounted in the extension projections of the side members.

3. The cassette-type roll stand according to claim 1, wherein the support frame is comprised of an upper crosshead and a lower crosshead and tension rods connecting the upper and lower crossheads, wherein an adjusting device is mounted underneath the upper crosshead and the supports for the roll stand and the measuring devices are mounted on the lower crosshead. are mounted on the lower crosshead.

4. The cassette-type roll stand according to claim 3, wherein the supports are rails.

5. The cassette-type roll stand according to claim 3, wherein the measuring devices are pressure pickups.

6. The cassette-type roll stand according to claim 3, wherein the adjusting device is a hydraulic adjusting device.

* * * * *